United States Patent [19]

Pasini et al.

[11] 4,326,812

[45] Apr. 27, 1982

[54] NON IMPACT PRINTER

[75] Inventors: Arnaldo Pasini, Ivrea; Franco Knirsch, Banchette, both of Italy

[73] Assignee: Ing. C. Olivetti & C., S.p.A., Ivrea, Italy

[21] Appl. No.: 169,844

[22] Filed: Jul. 17, 1980

[30] Foreign Application Priority Data

Jul. 20, 1979 [IT] Italy ..... 68569 A/79

[51] Int. Cl.[3] ..... B41J 3/02

[52] U.S. Cl. ..... 400/121; 101/DIG. 13; 346/156

[58] Field of Search ..... 400/119, 121; 101/1 R, 101/DIG. 13; 346/156

[56] References Cited

U.S. PATENT DOCUMENTS

| | | | |
|---|---|---|---|
| 3,257,222 | 6/1966 | Carlson | 346/156 X |
| 3,683,382 | 8/1972 | Ballinger | 101/DIG. 13 |
| 4,197,331 | 4/1980 | Gundlach et al. | 101/DIG. 13 |
| 4,208,965 | 6/1980 | Eichler | 101/DIG. 13 |

FOREIGN PATENT DOCUMENTS

| | | | |
|---|---|---|---|
| 734909 | 8/1955 | United Kingdom | 346/156 |

OTHER PUBLICATIONS

"Contact Electrostatic Printing", IBM Tech. Discl. Bulletin, vol. 13, No. 10, Mar. 1971, pp. 3117–3118.

"Non-Impact Printer-Typewriter", IBM Tech. Discl. Bulletin, vol. 7, No. 6, Nov. 1964, pp. 458–459.

*Primary Examiner*—E. H. Eickholt

*Attorney, Agent, or Firm*—W. R. Hulbert

[57] ABSTRACT

The printer comprises electrodes arrayed in circumferential rings and rows parallel to the axis of a cylinder. This axis corresponds to the vertical direction of characters printed on a sheet of paper. The print cylinder is moved in the direction of a line of print transversely to the direction of feed movement of the paper and rotates with respect to the paper in order to avoid sliding movement. A movable inked ribbon is disposed against the top face of the paper on which the printing is to be effected, and on the opposite side to the print cylinder. The inked ribbon is electrically conducting and connected to one terminal of the power supply which selectively energizes the electrodes. The ribbon is moved in the same direction as the print cylinder by means of drive rollers. The inked ribbon passes through an inking station for continuously renewing the layer of ink. The inked ribbon is also moved in the same direction as the paper by a face cam to ensure there is always a freshly inked band of the ribbon opposite the electrodes but this may not be necessary and is a feature omitted from a modified embodiment in which the ribbon rollers drive it in the direction of paper feed.

15 Claims, 3 Drawing Figures

NON IMPACT PRINTER

BACKGROUND OF THE INVENTION

The present invention relates to a non-impact printer of the type in which a row of electrodes spaced transverse to a print line are moved along the print line and selectively energised to cause the transfer of particles of ink from an ink carrier to a printing medium.

In a known printer of this type, a head provided with a vertical column of projecting electrodes is mounted on a closed belt and, on each revolution of the belt, the head passes with a sliding motion over an ink-impregnated fabric ribbon, moving in the direction of the length of the ribbon. The inked ribbon is turned to form a closed loop around two pulleys which cause the ribbon to rotate slowly with respect to the speed of the head. Besides the ribbon, there is provided a sheet of normal paper on which the electrodes print dots by an electrothermal effect when they are energised by suitable voltage pulses.

Such a device suffers from the disadvantage that the inked ribbon is subjected to wear because the relative movement of the head with respect to the ribbon causes the electrodes to slide over the ribbon over the entire length of the print line, and always in the same region, whereby the electrodes will wear the ribbon by digging furrows therein which, by cutting the fibres of the fabric, cause the ribbon to break.

The above-described disadvantages are overcome by the printer according to the invention, as set forth in the attached claims.

DESCRIPTION OF THE PREFERRED EMBODIMENT

Figure 1:
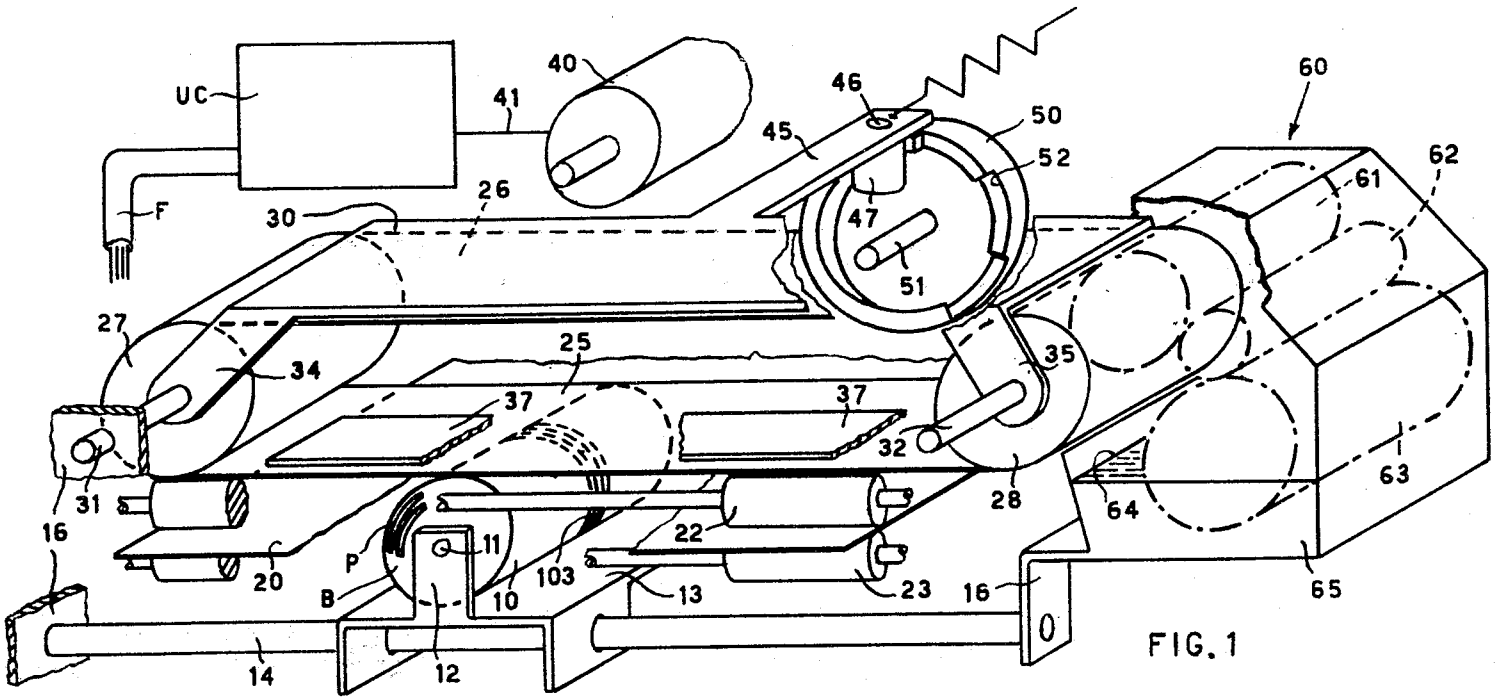
FIG. 1 is a diagrammatic perspective front view of a printer embodying the invention.

Referring to FIG. 1, a cylindrical print head 10 is fixed with respect to a shaft 11 which is rotatable on an arm 12 of a carriage 13 which is movably on guides 14 and 15 fixed to the frame 16 of the printing means. The head 10 is formed by two end cylinders 101 and 102 between which is clamped a pack of circular discs or plates 103 of electrically conducting material.

The discs 103 are insulated from each other and each disc has radial recesses or notches which extend inwardly from the outside edge and which define on the edge of the disc a series of sectors forming the printing electrodes. The stack of notched discs 103 form what may be called an electrode wheel. A head of this type is described in our copending patent application Ser. No. 166,982, filed July 8, 1980, entitled "Device and Method of Non Impact Printing".

The electrical connections between the discs 103 of the head and the outside control circuits can be formed for example with sliding contacts comprising concentric tracks P disposed in one end B of the head 10, against which slide brushes which are fixed to the carriage 13, (the brushes not being shown in the drawing for the sake of simplicity). Each brush is connected by means of one of the wires of a cable F to a control unit UC which in known manner generates high-voltage pulses of for example negative polarity, which are passed selectively to the various electrodes 103.

The head 10 can roll without sliding movement against a sheet of paper 20 which is disposed above the head 10 and which can be moved in a direction parallel to the axis of the shaft 11. The sheet of paper 20 is moved by a double line of rollers 22 and 23 disposed on opposite sides with respect to the sheet of paper 20, the rollers 23 being motor-driven.

Stretched above the sheet of paper 20 is a ribbon 25 of electrically conducting material which is wrapped into a closed belt around two rollers 27 and 28 whose axes of rotation are parallel to the axis of the head 10. The rollers 27 and 28 are mounted rotatably on an upper frame 30 which can move with a translatory motion with respect to the fixed frame 16 in a direction parallel to the axis of the head 10. The rollers 27 and 28 are fixed on shafts 31 and 32 respectively which extend beyond arms 34 and 35 of the frame 30 and are rotatable in the fixed frame 16. The shafts 31 and 32, in addition to acting as supports for the rollers 27 and 28, support and guide the upper frame 30 with respect to the fixed frame 16. A rigid plate 37 which is fixed to the frame 16 is disposed against the inside surface of the ribbon 25, at a position corresponding to the zone of electrodes 103 in the head 10, so as to form a flat support for resisting the slight pressure applied by the head against the ribbon 25.

At the rear, the shaft 31 is coupled to a stepping motor 40 which is supplied by a wire 41 from the control unit UC in a manner which will be described in greater detail hereinafter. The coupling is not shown but allows axial movement of the shaft 31 relative to the motor.

The upper frame 30 is provided with an arm 45 which extends rearwardly and which is provided with a pivot pin 46 on which a small wheel or roller 47 is rotatable. The small roller 47 co-operates with a face cam 50 which is rotatable on a shaft 51 parallel to the shaft 31 and coupled (again by means not shown) to the drive rollers 23. The cam 50 has a configuration forming steps 52 gradually descending with respect to a predetermined direction of rotation. The height between two successive steps is equal to the height of the matrix of the characters printed by the head 10. The last or lowest step **52*e* of the cam 51 is connected to the first or highest 52*a* by an inclined portion 52*f*. The transmission ratio between the drive rollers 23 and the cam 50 is such that, for each feed movement of a line spacing of the sheet of paper 20, the cam 50 rotates through an angle such as to bring a following step to the roller 47. In this way, for each line printed by the head 10 on the sheet of paper 20, the ribbon 25 moves parallel to itself by an amount equal to the height of the printed characters. A return spring 53 holds the roller 47 in continuous contact with the cam 50**.

The ribbon 25 is covered over its outside surface 26 with a layer of ink which is deposited and continuously renewed by a regeneration station 60 comprising three rollers 61, 62 and 63 which transfer the ink 64, which is kept fluid by a heater, from a container 65 within which the roller 63 is partially immersed, to the ribbon 25 to which the roller 61 is adjacent. Further details regarding the regeneration station 60 can be found in our copending application Ser. No. 166,982, filed July 8, 1980.

The ink used is of the type formed by a mixture of hydrocarbon waxes and finely ground carbon powder.

Various ink formulations which are suited to the purpose can be found in the specification of our Italian patent No. 1,004,991.

Figure 2:
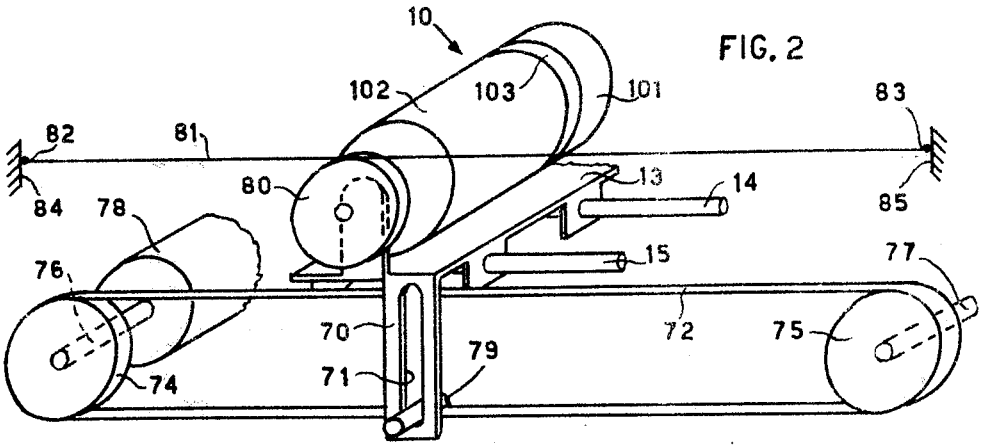
FIG. 2 is a diagrammatic perspective rear view of the printer of FIG. 1.

FIG. 2 shows the arrangement for moving the head along the print line. The carriage 13 has in its rearward part an arm 70 which is bent vertically downwardly and which has a straight slot 71 extending in the direction of its length. A belt 72 is wrapped around two pulleys 74 and 75 which are connected to shafts 76 and 77 which are rotatable in the frame 16 and which are parallel to the shaft 11, the shaft 76 being connected to a motor 78. A pin 79 is fixed transversely on the belt 72 and engages the slot 71 so that, during the rotary movement of the pulleys 74 and 75, the carriage is reciprocated along the guides 14 and 15 over the distance between the shafts of the pulleys 74 and 75.

A pulley 80 which is of the same diameter as the head 10 is fixed on the shaft 11 rearwardly of the head 11, and a flexible and inextensible cord or cable 81 is wrapped once around the pulley 80. The two ends 82 and 83 of the cord 81 are fixed to fixed points 84 and 85 respectively of the fixed frame 16. When the carriage moves, the cord 81 rotates the pulley 80 and therewith the print head 10 which rotates at a peripheral speed which is equal to but opposite to the speed of translatory movement of the carriage, whereby it rolls without sliding against the sheet of paper 20 (see FIG. 1) which is disposed thereabove.

When the control unit UC calls for serial printing of a line, the motor 78 is energised, which thus rotates the pulleys 74 and 75 which in turn cause translatory and rotary movement of the head 10. At the same time, possibly after a delay depending on the position of starting printing, the unit UC supplies on the cable F the high-voltage pulses which are selected in accordance with predetermined print codes. The electrodes 103 which are thus selectively energised cause current pulses to pass from the ribbon 25 which is connected by means of the metal structure to the positive terminal 85 of the unit UC, through the paper 20, to each energised electrode. This flow of current causes local softening of a small portion of ink which is removed from the ribbon and applied to the paper, thereby printing a dot thereon.

When a complete line has been printed, the unit UC causes rotary movement of the rollers 22 and 23 by means of a motor connected thereto (the motor is not shown in the drawings for the sake of simplicity) to advance the paper 20 by one or more line spacings, according to requirements, and at the same time to rotate also the cam 50 to move the following step of the cam configuration 52 into contact with the roller 47. In this way the ribbon 25 is moved parallel to itself by an amount equal to the height of the printed character so as to bring a fresh strip of ink into alignment with the electrodes 103.

After the cam 50 has completed a full revolution, the ribbon 25 is returned to its original position and at that point the unit UC energises by means of the lead 41 the motor 40 to cause the ribbon 25 to advance by a distance equal to the distance between the axes of the shafts 31 and 32, thereby renewing the layer of ink for the entire width of the ribbon 25.

Figure 3:
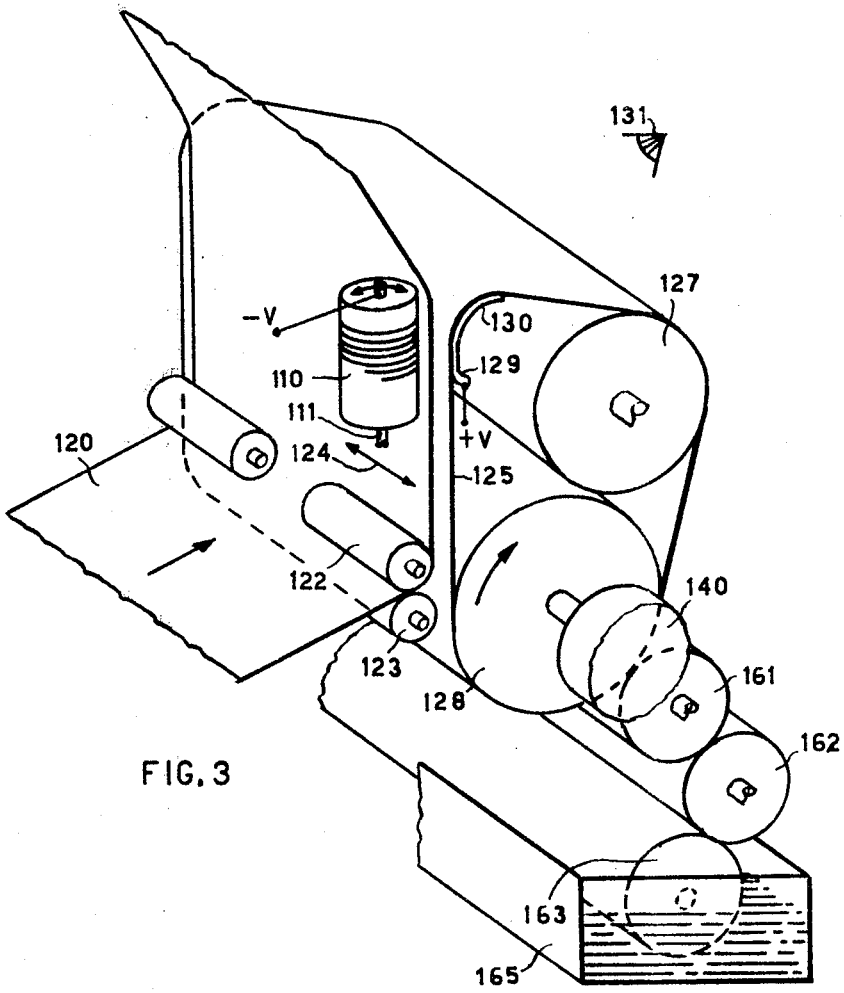
FIG. 3 shows an alternative arrangement of the printer.

FIG. 3 shows a second embodiment in which the visibility of each line printed is improved. A cylindrical head 110 of the abovedescribed type is disposed with a vertical axis in front of a paper carrier 120 which is moved upwardly by a double line of rollers 122 and 123, of which the rollers 123 are motor-driven in any of the ways known in the art.

The head can be moved horizontally in the two directions indicated by a double arrow 124 transversely with respect to the paper 120 and can roll without sliding on the paper, rotating about a vertical axis 111. The head 110 is carried by a carriage which is not shown in FIG. 3 for the sake of simplicity but which is generally similar to that shown in FIGS. 1 and 2. Likewise therefore the translatory movement of the carriage and the rotary movement of the head can be produced in the same manner as already described above.

Behind the paper 120 with respect to the head 110 there is disposed a ribbon 125 which is of electrically conducting material and which is turned around two rollers 127 and 128. A shaped backing element 129 is disposed against the surface of the ribbon which is opposite the surface in contact with the paper 120. The element 129 has at 130 an edge portion which is bent rearwardly with respect to the paper 120, over which the ribbon 125 passes immediately beyond the print region in order to facilitate reading of the last line printed, for an observer at the viewing position indicated by reference 131.

The width of the ribbon 125 is at least equal to the maximum length of the line of typing on the sheet 120. The ribbon 125 is covered on its outside surface which is in contact with the paper 120, by a layer of inking material of the above-indicated type.

The roller 128 is rotated by a stepping motor 140 in synchronisation with the forward movement of the paper, by means of rollers 123 which are connected to the motor 140 by a speed change means of known type (not shown in the drawing) so as to impart to the paper the same feed movement as the ribbon 125, thus avoiding any relative sliding movement.

The layer of ink on the ribbon 125 is continuously renewed by a regeneration station 160 which is similar to the station 60 in FIG. 1, and which comprises three inking rollers 161, 162, and 163, of which the roller 163 is partially immersed in a container 165 containing ink 164 which is maintained fluid. The intermediate roller 162 transfers a small amount of ink to the roller 161 which in turn deposits the ink on the ribbon 125.

The mode of operation of the arrangement illustrated in FIG. 3 is simpler than FIG. 1. In fact, the ribbon 125 moves at the same speed as the paper, in each line spacing, and thus automatically moves a fresh region of ink into alignment with the lines of print. The motor 140 is energised to follow the line spacing both of the ribbon 125 and of the paper 120 insofar as, as already stated, the paper feed rollers 123 are connected to the motor 140.

What we claim is:

1. A non-impact dot-matrix printer for printing alphanumeric characters on a printing medium, comprising an electrode wheel having a row of electrodes spaced axially along the periphery of the wheel, means for supporting the printing medium between the wheel and an ink carrier, means for selectively energising the electrodes relative to the ink carrier with electrical pulses which cause dots of ink to transfer from the ink carrier to the printing medium, and means arranged to move the electrode wheel transversely with a rolling, non-sliding movement relative to the recording medium, along a print line.

2. A printer according to claim 1, wherein the wheel carries a plurality of rows of the electrodes.

3. A printer according to claim 2, wherein the electrodes also lie in circumferential rings, the electrodes of each ring being electrically interconnected.

4. A printer according to claim 3, wherein the ink carrier is a ribbon.

5. A printer means according to claim 4, wherein the ink carrier is moved in such a way as to eliminate sliding movement between the ink carrier and the printing medium.

6. A printer according to claim 4, comprising a flat backing element which is disposed on the opposite side of the ink ribbon with respect to said electrodes, and wherein the ink ribbon moves in a transverse direction with respect to the print line to bring into alignment with the print line a fresh portion of the ink ribbon for each travel movement of the electrode wheel.

7. A printer according to claim 6, wherein the ribbon has a width equal to a predetermined integral multiple of the height of the dot matrix, and passes around a pair of rollers.

8. A printer according to claim 7, wherein ribbon is circulated around the rollers after it has moved with a translatory motion a number of times equal to the integral multiple, for renewing the inking material.

9. A printer according to claim 4, wherein the width of the ribbon is at least equal to the maximum length of a line printed on the printing medium.

10. A printer according to claim 9, wherein the ribbon is fed by rollers in the direction transverse to the print line.

11. A printer according to claim 10, wherein the backing element has a curved end portion in contact with the ribbon for moving the ribbon away from the printing medium, thereby permitting the last line of characters printed to be immediately visible.

12. A printer according to claim 11, wherein the electrode wheel is displaced by a mechanism for alternately displacing the wheel in opposite directions along the print line, associated with a device for rotating the wheel in a predetermined direction asociated with the direction of displacement.

13. A printer according to claim 12, wherein the said mechanism comprises a movable carriage carrying the wheel, a belt stretched between and rotatable about a pair of pulleys, a pin fixed to the belt and co-operating with the carriage for moving the carriage alternately in opposite directions parallel to the print line.

14. A printer according to claim 13, wherein the device for rotating the wheel comprises a pulley connected to the wheel, and a cord which is wrapped around the pulley and which has its ends connected to two fixed points of the printer.

15. A printer according to claim 14, wherein the pulley has a diameter which is equal to the diameter of the electrode wheel.

* * * * *